US006585389B2

(12) United States Patent
Bonazzi

(10) Patent No.: US 6,585,389 B2
(45) Date of Patent: Jul. 1, 2003

(54) LUMINAIRE, PARTICULARLY OF THE CEILING-MOUNTED TYPE OR OF THE TYPE FOR RECESSED FITTING IN CEILINGS AND WALLS

(75) Inventor: Romano Bonazzi, Pianoro (IT)

(73) Assignee: 3F Filippi S.p.A., Pian di Macina-Pianoro (IT)

( * ) Notice: Subject to any disclaimer, the term of this patent is extended or adjusted under 35 U.S.C. 154(b) by 0 days.

(21) Appl. No.: 10/068,982

(22) Filed: Feb. 11, 2002

(65) Prior Publication Data

US 2002/0109983 A1 Aug. 15, 2002

(30) Foreign Application Priority Data

Feb. 15, 2001 (IT) ..... BO2001A0083

(51) Int. Cl.[7] ..... F21S 8/00
(52) U.S. Cl. ..... 362/147; 362/292; 362/364
(58) Field of Search ..... 362/147, 292, 362/296, 293, 330, 346, 367, 364

(56) References Cited

U.S. PATENT DOCUMENTS 4,475,147 A * 10/1984 Kristofek ..... 362/148
6,443,592 B1 * 9/2002 Unger et al. ..... 362/147
6,457,848 B1 * 10/2002 Wolf et al. ..... 362/364

* cited by examiner

*Primary Examiner*—Sandra O'Shea
*Assistant Examiner*—Ronald E. DelGizzi
(74) *Attorney, Agent, or Firm*—Guido Modiano; Albert Josif; Daniel O'Byrne

(57) ABSTRACT

A luminaire, of the ceiling-mounted type or of the type for recessed fitting in ceilings and walls for interior lighting, comprising a hollow body which is shaped like a paraboloid and forms a back on an upper part and an opening on a lower part, the body accommodating a light source in its internal cavity; the internal surface of the body is divided into sectors which form receptacles that can be engaged detachably by a plurality of reflective laminar elements in order to form various hues, chromatic compositions and/or light distributions.

11 Claims, 7 Drawing Sheets

LUMINAIRE, PARTICULARLY OF THE CEILING-MOUNTED TYPE OR OF THE TYPE FOR RECESSED FITTING IN CEILINGS AND WALLS

BACKGROUND OF INVENTION

The present invention relates to a luminaire, particularly of the ceiling-mounted type or of the type for recessed fitting in ceilings, walls and the like for lighting interiors, such as for example offices, corridors, display spaces of shops, showrooms and others.

It is known that devices of the above mentioned type, manufactured according to the most disparate criteria, are commercially available and have considerable problems; these devices in fact do not allow to control light distribution and have an inefficient luminance, which is defined according to the ICI (International Commission on Illumination) standard as the luminous intensity emitted in a given direction by a surface that is illuminated by reflection (or light source) per unit projected surface (i.e., the surface normal to that direction). The above cited problems negatively affect the visual comfort of the user.

SUMMARY OF THE INVENTION

The aim of the present invention is to obviate the above cited drawbacks, by providing a luminaire in which it is possible to generate and control light distributions according to visual tasks and viewing orientations.

Within this aim, an object of the present invention is to provide optimum visual comfort and prevent deformation of reflected images, thus helping to improve said environmental comfort.

Another object of the present invention is to achieve the above aim and object with a structure that is simple, relatively easy to provide in practice, safe in use, effective in operation, and has a relatively low cost.

This aim and these and other objects that will become better apparent hereinafter are achieved by the present luminaire, particularly of the ceiling-mounted type or of the type for recessed fitting in ceilings, walls and the like for interior lighting, which consists of a hollow body which is shaped like a paraboloid and forms a back on an upper part and an opening on a lower part, said body accommodating a light source in its internal cavity, characterized in that the internal surface of said body is divided into sectors which form receptacles that can be engaged detachably by a plurality of reflective laminar elements in order to form various hues, chromatic compositions and/or light distributions.

BRIEF DESCRIPTION OF THE DRAWINGS

Further characteristics and advantages of the present invention will become better apparent from the following detailed description of a preferred but not exclusive embodiment of a luminaire, particularly of the type for recessed fitting in ceilings, walls and the like for interior lighting, according to the invention, illustrated only by way of non-limitative example in the accompanying drawings, wherein.

DESCRIPTION OF THE PREFERRED EMBODIMENTS

Figure 1:
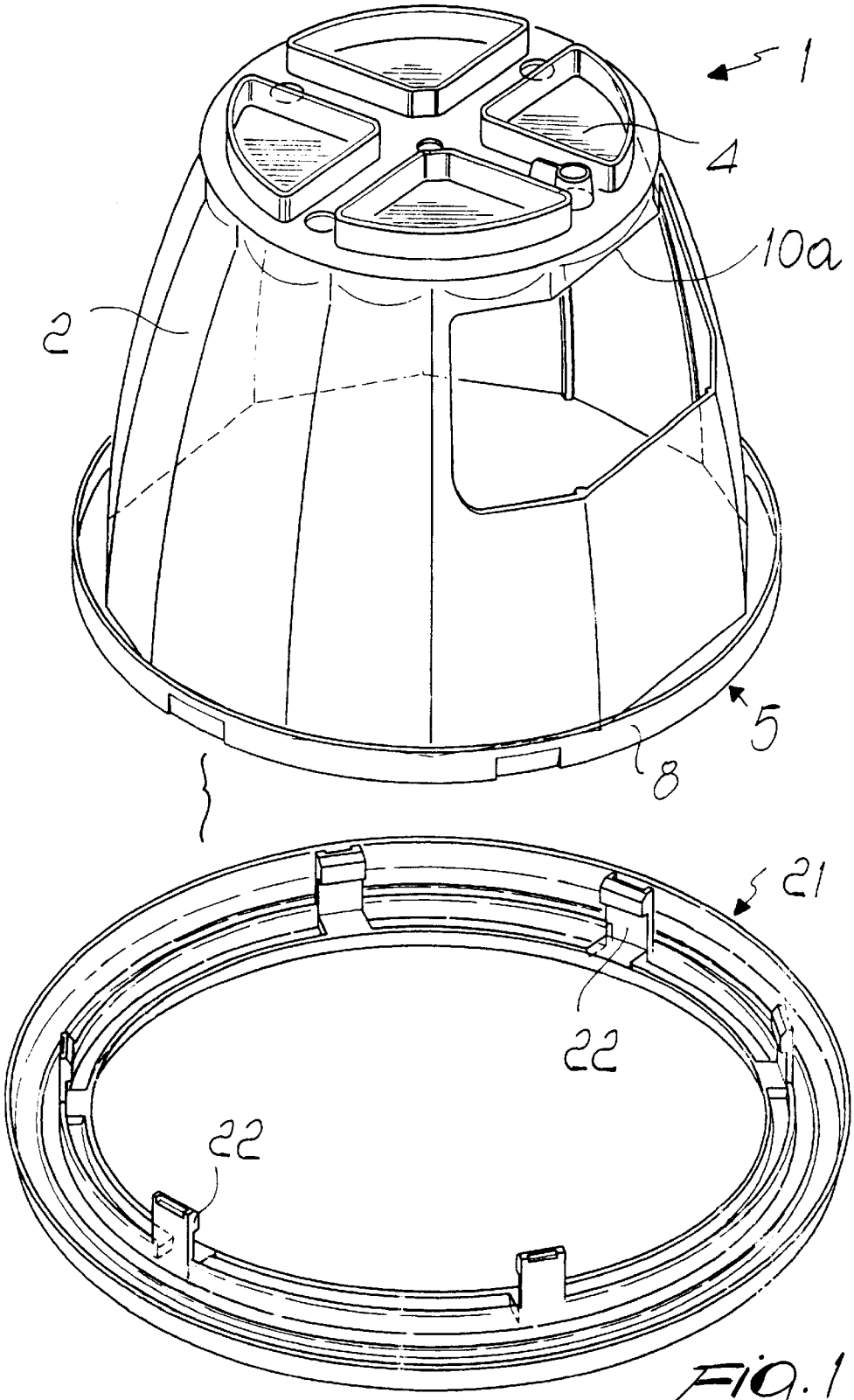
FIG. 1 is a top perspective exploded view of the luminaire according to the invention.
Figure 2:
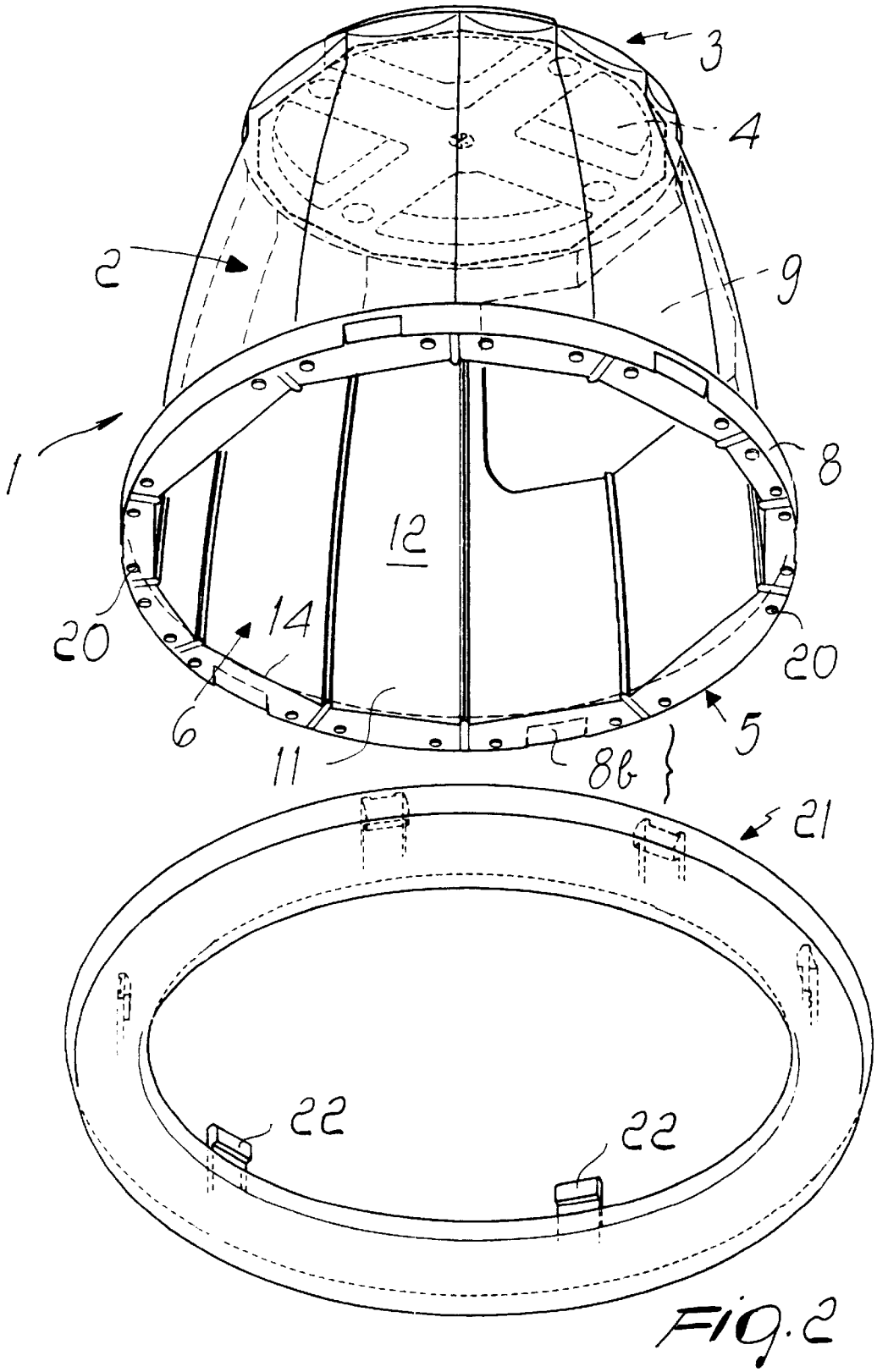
FIG. 2 is a bottom perspective exploded view of the luminaire.
Figure 3:
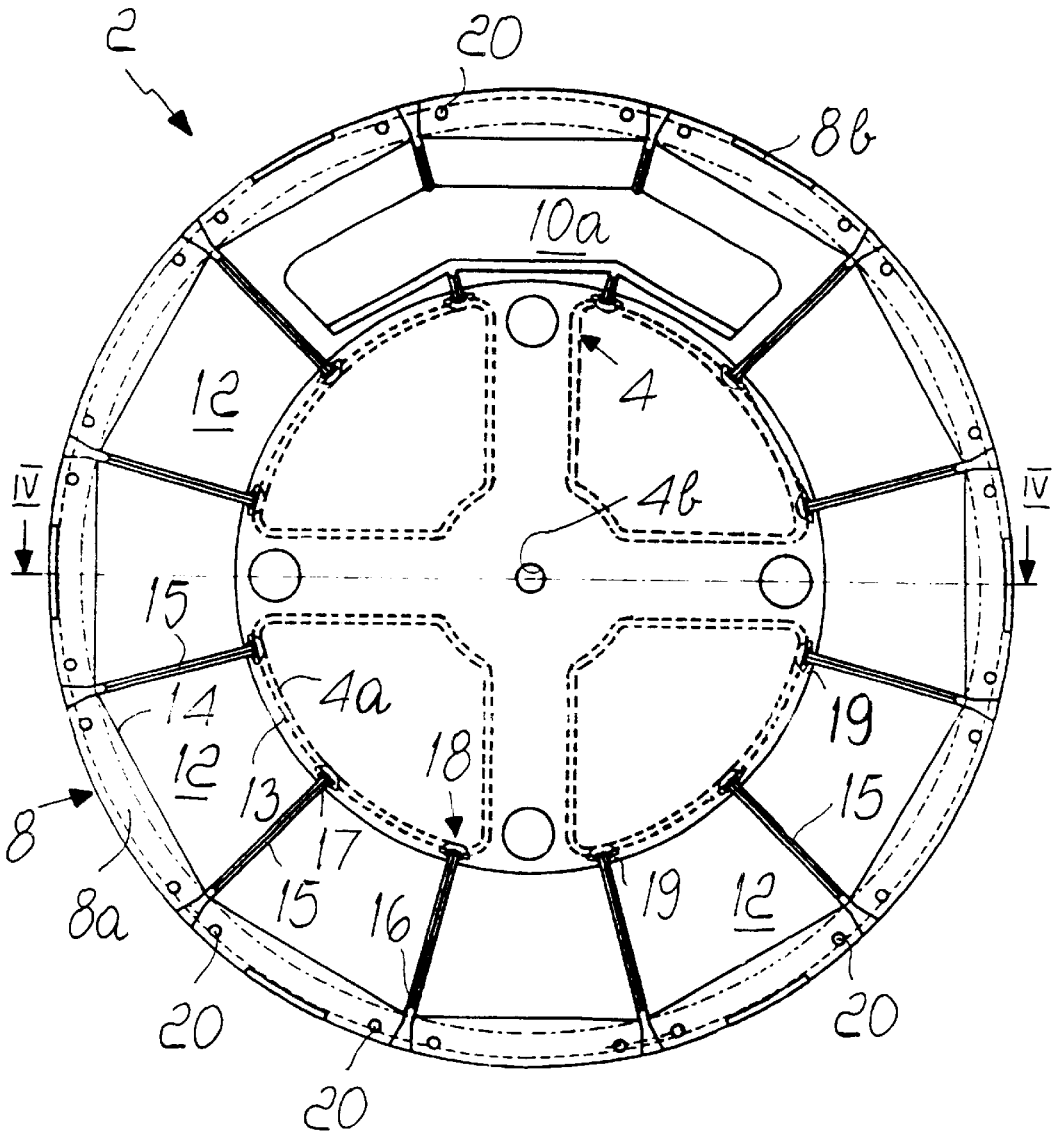
FIG. 3 is a bottom view thereof.
Figure 4:
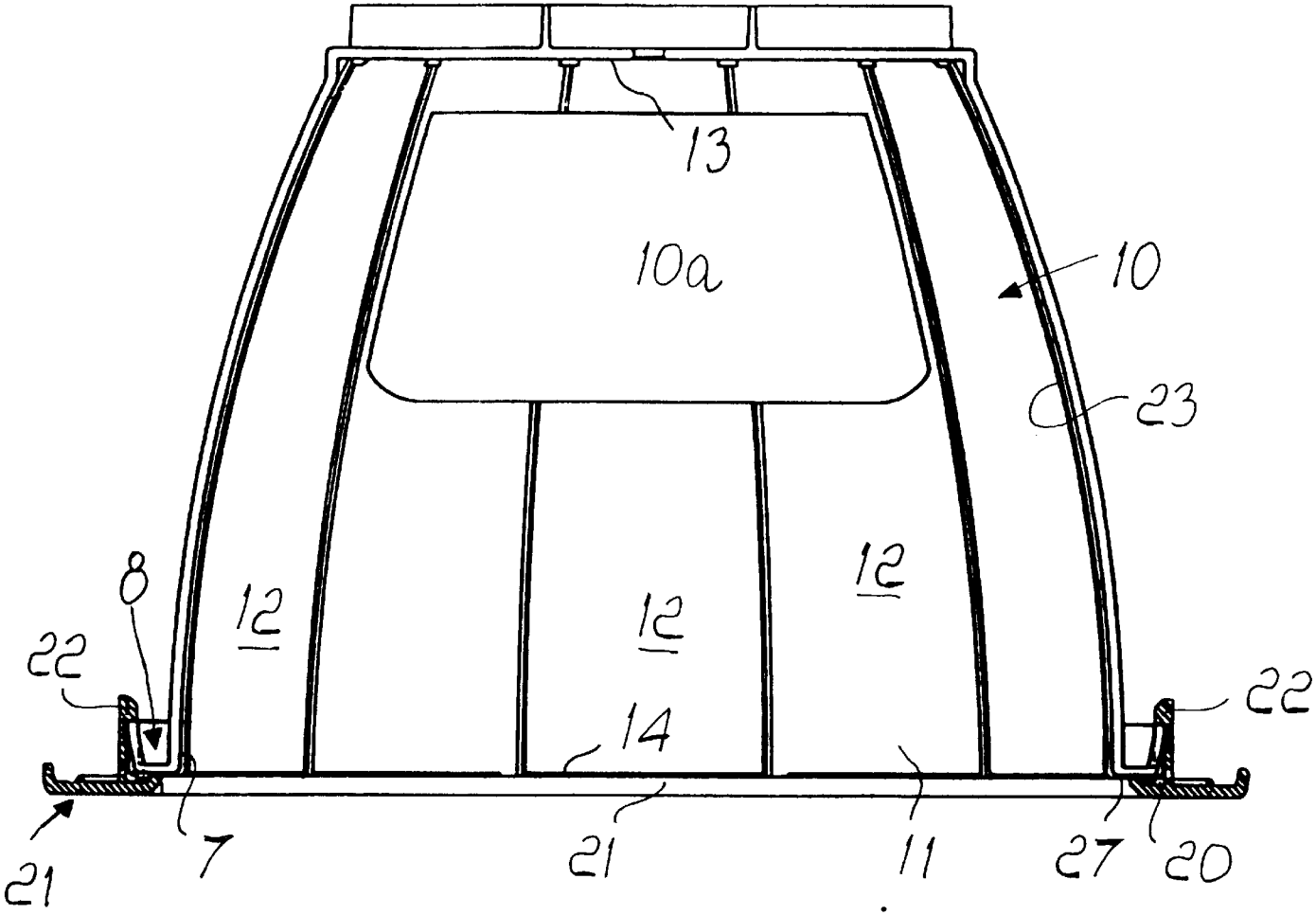
FIG. 4 is a sectional view, taken along the line IV—IV of FIG. 3, with a flange associated with the body.
Figure 5:
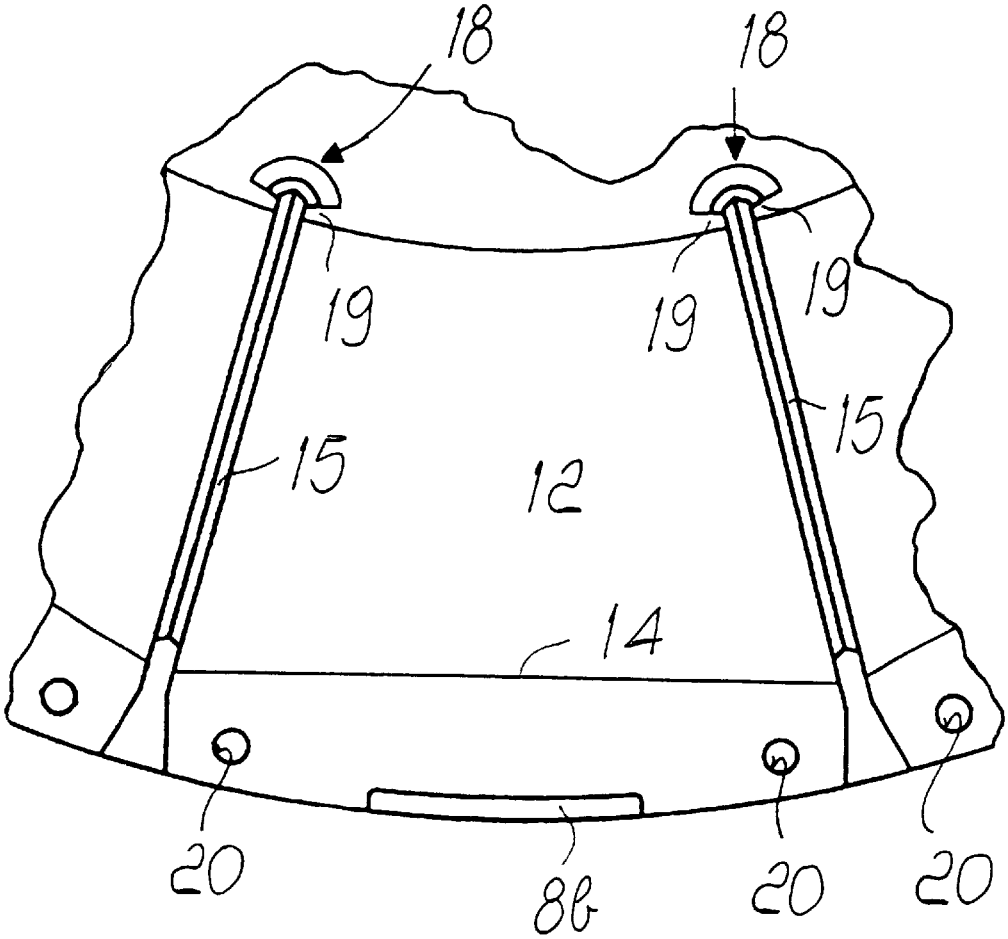
FIG. 5 is a view of a detail of a receptacle.
Figure 6:
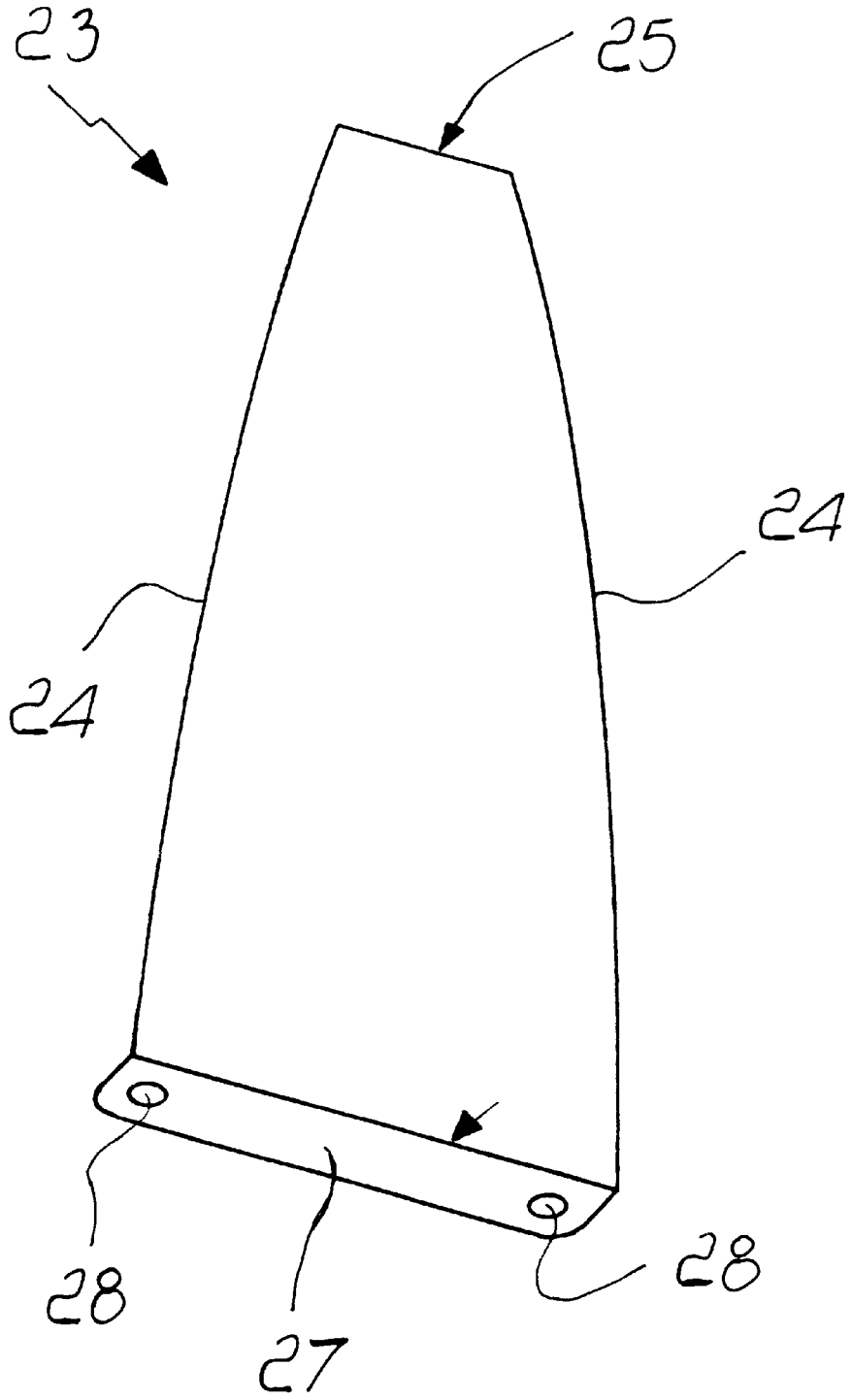
FIG. 6 is a perspective view of a laminar element of the luminaire.
Figure 7:
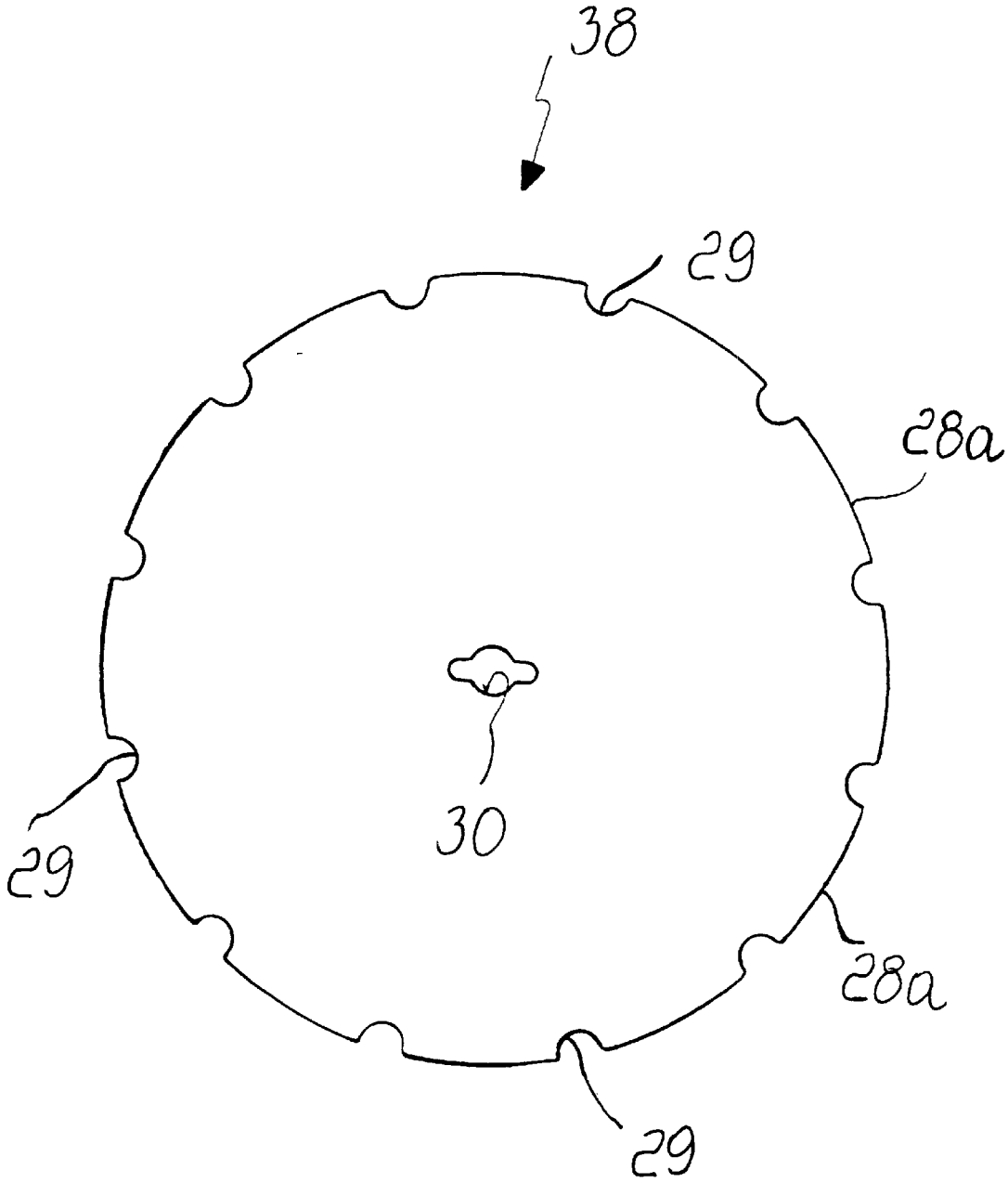
FIG. 7 is a plan view of a disk of the luminaire.

With particular reference to the figures, the reference numeral 1 generally designates a luminaire according to the invention. The luminaire 1 consists of a hollow body 2 shaped like a paraboloid, as shown in FIGS. 1 and 2. The body 2 has an upper part 3, which forms a back 4, and a lower part 5, which forms an opening 6 provided on a perimetric edge 7 of a flange 8. The opening 6 provides access to a cavity 9 delimited by an internal surface 10 of the body 2 that accommodates the light source, which is connected to electric power supply means through a passage 10*a* formed at an upper central region of the surface. The power supply means and the light source are not shown in the accompanying drawings, since they are fully known from the background art.

The internal surface 10 is divided into sectors 11, which longitudinally and equally form trapezoidal receptacles 12. The receptacles 12 comprise a shorter end side 13, which is adjacent to a locator 4*a* of the back 4, a longer end side 14, which is located at the flange 8, and ridges 15, which delimit the adjacent receptacles 12. The ridges 15 run longitudinally from one end 16, at the flange 8, to an opposite end 17, which is adjacent to the locator 4*a*, where enlarged portions 18 protrude, forming retention notches 19.

The flange 8 has, at the annular strip 8*a* folded at right angles to the internal surface 10, pins 20 distributed in pairs with a constant spacing for each sector 11. A ring 21 is associated with the flange 8 and is provided with teeth 22, which detachably engage, with a snap action, slots 8*b* formed in the flange 8.

The receptacles 12 can be engaged slidingly and detachably by reflective laminar elements 23, which have a trapezoidal shape that is substantially complementary to the receptacles 12. The laminar element 23 is constituted by lateral sides 24, a shorter end side 25, and a longer end side 26, at which there is a portion 27 which is folded at right angles with respect to the surface of the laminar element and in which holes 28 are provided. When the laminar element 23 is inserted in one of the receptacles 12, the lateral sides 24 are retained by the ridges 15, while the shorter end side 25 and the holes 28 respectively engage the retention notches 19 and the pins 20.

The luminaire 1 comprises a laminar disk 38, which is provided peripherally with cutouts 29, which are shaped complementarily to the enlarged portions 18, and with a central eyelet 30. The disk 38 is meant to be fixed at the locator 4*a* by means of a screw that passes through the eyelet 30 and the hole 4*b*. The fixing of the disk 38 allows the abutment of the perimetric line 28*a* on the shorter end side 25 so as to further lock the laminar element 23.

Conveniently, the laminar element 23 and the disk 38 form reflective surfaces obtained by means of aluminum metallization processes and may be of different kinds of aluminum. Moreover, the reflective surface of the laminar element 23 has a curvature that does not distort the image, thus providing good visual comfort in the surrounding environment.

In practical operation, before seating the luminaire at the ceiling or walls, the body 2 is assembled by first inserting the disk 38 and the laminar elements 23 in the receptacles 12, then the flange 8 is inserted, thus ensuring the locking of the laminar elements in the body 2.

According to requirements, determined for example by the various light distributions, laminar elements 23 of various types of material are inserted in the receptacles 12 in order to meet said requirements.

It has thus been shown that the invention achieves the intended aim and objects.

In particular, the fact is stressed that the possibility to insert one or more laminar elements 23 allows to adjust the luminance.

The invention thus conceived is susceptible of numerous modifications and variations, all of which are within the scope of the inventive concept.

All the details may furthermore be replaced with other technically equivalent ones.

Advantageously, it is possible to cover the internal surface 10 with a film of different types of aluminum obtained by means of an aluminum metallization process.

In practice, the materials used, as well as the shapes and the dimensions, may be any according to requirements without thereby abandoning the scope of the protection of the appended claims.

The disclosures in Italian Patent Application No. BO2001A000083 from which this application claims priority are incorporated herein by reference.

What is claimed is:

1. A luminaire, of the ceiling-mounted type or of the type for recessed fitting in ceilings and walls for interior lighting, comprising a hollow body shaped like a paraboloid and forming a back on an upper part and an opening on a lower part, said body being adapted to accommodate a light source in an internal cavity thereof, wherein the internal surface of said body is divided into sectors which form receptacles that can be engaged detachably by a plurality of reflective laminar elements in order to form various hues, chromatic compositions and/or light distributions.

2. The luminaire according to claim 1, wherein said elements and said receptacles have a trapezoidal shape.

3. The luminaire according to claim 1, further comprising, at a shorter end side of said receptacles, enlarged portions which form retention notches adapted to engage a respective shorter end side of said element.

4. The luminaire according to claim 3, wherein said receptacles are delimited longitudinally and equally by ridges which are adapted to retain lateral sides of said laminar elements.

5. The luminaire according to claim 4, wherein said retention notches are provided at said back and at an end of said ridges.

6. The luminaire according to claim 1, wherein said body comprises, at a perimetric edge of said opening, a flange provided with pins.

7. The luminaire according to claim 6, wherein said pins are two for each one of said sectors.

8. The luminaire according to claim 6, wherein said laminar elements have, at longer end sides thereof, a portion which is folded at right angles and engages said pins by means of holes.

9. The luminaire according to claim 3, further comprising a laminar disk which is peripherally provided with cutouts which are complementary to said enlarged portions, said disk being meant to be accommodated at said back in order to lock, with perimetric edges thereof, said shorter end side of said laminar elements.

10. The luminaire according to claim 6, further comprising a ring which detachably engages, with an interlocking action by means of teeth, said flange in order to lock said laminar elements at longer end sides thereof.

11. The luminaire according to claim 1, wherein said laminar elements are made of different types of material.

* * * * *